United States Patent [19]

Mueller

[11] 4,420,866

[45] Dec. 20, 1983

[54] APPARATUS AND PROCESS FOR SELECTIVELY EXPANDING TO JOIN ONE TUBE INTO ANOTHER TUBE

[75] Inventor: Richard A. Mueller, Tulsa, Okla.

[73] Assignee: Cities Service Company, Tulsa, Okla.

[21] Appl. No.: 342,252

[22] Filed: Jan. 25, 1982

[51] Int. Cl.[3] ..... B23P 17/00; B21D 39/08; B21D 39/20

[52] U.S. Cl. ..... 29/421 R; 29/283.5; 29/523; 72/58

[58] Field of Search ..... 29/421 R, 523, 237, 29/283.5; 72/58

[56] References Cited

U.S. PATENT DOCUMENTS

| | | | |
|---|---|---|---|
| 2,458,854 | 1/1949 | Hull et al. | 72/58 |
| 2,535,403 | 12/1950 | Froggartt | 72/58 X |
| 2,748,463 | 6/1956 | Mueller | 29/523 |
| 3,094,773 | 6/1963 | Bukoff | 29/523 X |
| 3,103,068 | 9/1963 | Hinz et al. | 29/523 |
| 3,113,377 | 12/1963 | Oakes, Jr. | 29/523 |
| 3,152,630 | 10/1964 | Nilsson | 72/58 X |
| 4,069,573 | 1/1978 | Rogers, Jr. et al. | 29/523 X |
| 4,075,755 | 2/1978 | Bernatt et al. | 29/421 R X |
| 4,152,821 | 5/1979 | Scott | 29/421 R |

*Primary Examiner*—Charlie T. Moon

*Attorney, Agent, or Firm*—Robert H. Sproule; John W. Carpenter; George L. Rushton

[57] ABSTRACT

An apparatus and process for expanding a tube at selective points about its circumference to join with another tube. After a segment of a first tube is inserted into a second tube having an end sleeve segment with a larger diameter and wall thickness than the first tube, compression and subsequent radial expansion of one or more elastomeric bars lodged within longitudinal slots of a bushing means locted within the first tube end segment cause the elastomer to radially expand the wall of the first tube. The wall of the first tube expands at selective points against the wall of the second tube in proximity to their respective ends, creating a selective interference fit therebetween.

14 Claims, 8 Drawing Figures

APPARATUS AND PROCESS FOR SELECTIVELY EXPANDING TO JOIN ONE TUBE INTO ANOTHER TUBE

BACKGROUND OF THE INVENTION

1. Field of the Invention

The present invention relates to an apparatus and process for joining a tube inserted within another tube in proximity to their respective ends. More particularly, the apparatus and process of the present invention involve the compression and subsequent radial expansion of one or more elastomeric bars slidably lodged within longitudinal slots of a bushing means. The elastomeric bars expand against the inner surface of the first tube at selective points causing selective expansion of the tube wall against the inner surface of the second tube to create a selective interference fit between the wall of the first tube and the wall of the second tube in proximity to their respective ends.

2. Description of the Prior Art

Prior art methods of expanding tubes include the use of metal rollers located inside the tube which move outwardly from a central position as the rollers are mechanically rotated about the central position. Such methods typically expand the tube only in a round shape about the entire circumference of the tube with the final shape of the tube being a concentric circle relative to the starting position of the tube. In my invention, longitudinal zones of expansion are used to mechanically lock the tubes together, while creating non-expanded zones to permit fluids or gases to flow from inside to outside the tubes at the expansion joint between the tubes.

Other prior art such as U.S. Pat. No. 4,109,365 by Tygart involve the compression of hard rubber or polyurethane by piston forces applied from both ends of the tube, thereby making it difficult to expand the tube at great distances from either end of the tube as when an expandable joint is made in tubular piling at the bottom of the ocean. My invention utilizes a compression force applied from only one end of the tube thereby allowing expansion to occur deep within the tube.

U.S. Pat. No. 4,152,821 by Scott teaches a process for joining a plastic pipe to a plastic or metal coupling by compression of a rubber plug against the inner walls of the plastic pipe. My present invention is not limited to the joining of plastic pipe to a coupling, but rather involves the joining of pipe made of any expandable material to a second pipe. In addition, all prior art including U.S. Pat. No. 4,006,619 by Anderson teaches expansion of the first tube entirely about its circumference to create a close fit between the tubes entirely about their circumferences. My invention, on the other hand, teaches expansion of the first tube at selective locations about its circumference to join with a second tube, yet provide passageways for fluids or other materials to pass through the annular spaces between the tubes. For example, these annular spaces between the tubes may be used for the passage of concrete or other cementitious material from inside one section of tube to outside and around the outer surface of a joined section of tube. In addition, the annular spaces may provide passageways for the escape of gases from inside the tubes to the outside atmosphere. Therefore, what is needed and what has been invented is a process and apparatus for expanding to join at least one pair of tubes without the foregoing deficiencies associated with prior art processes and apparatuses.

SUMMARY OF THE INVENTION

The present invention accomplishes its desired objects by broadly providing an apparatus and process for expanding to join one tube into another tube in proximity to their respective ends by forming a selective interference fit therebetween. The apparatus comprises a first tube including a shaft extending axially inside the first tube, an inner cap bound to the shaft for longitudinal axial movement in combination with the shaft with respect to the first tube, and an outer cap including at least one prong means bound thereto, slidably mounted on and along the shaft for longitudinal axial movement on and along the shaft with respect to the first tube. The invention also comprises a bushing means, including at least one longitudinal slot which longitudinally traverses the bushing means, slidably mounted on and along the shaft between the outer cap and the inner cap for longitudinal axial movement on and along the shaft with respect to the first tube, the prong means of the outer cap slidably lodged within the longitudinal slot. In addition, the invention includes an elastomeric means slidably lodged within the longitudinal slot of the bushing means, and a second tube with an end sleeve segment having a greater diameter than the first tube. The end sleeve segment defines a female opening to slidably mate with an end segment of the first tube, which includes the elastomeric means therein, such that the inner surface of the end sleeve segment of the second tube overlaps the outer surface of the end segment of the first tube.

The invention also comprises a means for pulling the shaft in one axial direction while simultaneously pushing the outer cap in the opposite axial direction, such that the inner cap contacts the bushing means and the prong means contacts the elastomeric means. The continuing respective axial forces from pulling and pushing, in combination with the prong means of the outer cap in contact with the elastomeric means within the longitudinal slot, compress and thereby radially expand the elastomeric means at predetermined selective locations against the end segment wall of the first tube. Selective radial expansion of the elastomeric means against the inner surface of the first tube end segment causes the first tube wall to selectively radially expand against the inner surface of the second tube to form a selective interference fit between the end segment wall of the first tube and the end sleeve segment wall of the second tube.

The process for joining at least one pair of tubes by expanding a first tube into a second tube in proximity to their respective ends by forming a selective interference fit between the tubes comprises placing the shaft axially inside a first tube, mounting the bushing means slidably on and along the shaft, and mounting the outer cap including the prong means bound thereto on and along the shaft. In addition, the process includes sizing the end sleeve segment of the second tube such that the end sleeve segment has a larger diameter than the first tube, registering the end segment of the first tube within the end sleeve segment of the second tube, and pulling the shaft in one axial direction while simultaneously pushing the outer cap in the opposite axial direction to radially expand the elastomeric means at predetermined selective locations against the end segment wall of the first tube. The selective radial expansion of the elastomeric means causes selective radial expansion of the end segment of the first tube against the end sleeve segment of the second tube to form a selective interference fit therebetween.

It is therefore an object of this invention to provide a process and apparatus for expanding to join one tube into another tube in proximity to their respective ends.

It is another object of this invention to provide a process and apparatus for expanding to join one tube into another tube in proximity to their respective ends when either or both tubes are out-of-round.

It is yet another object of this invention to provide a process and apparatus for selective expanding to join one tube into another tube in proximity to their respective ends in order to provide passageways between the tubes for fluids or other materials to pass through.

It is still another object of this invention to provide a process and apparatus for selectively expanding to join one tube into another tube in proximity to their respective ends at locations remote from the free end of either tube.

These together with various ancillary objects and features which will become apparent as the following description proceeds are obtained by this novel apparatus and process, preferred embodiments being shown in the accompanying drawings by way of example only, wherein:

DETAILED DESCRIPTION OF THE INVENTION

Figure 1:
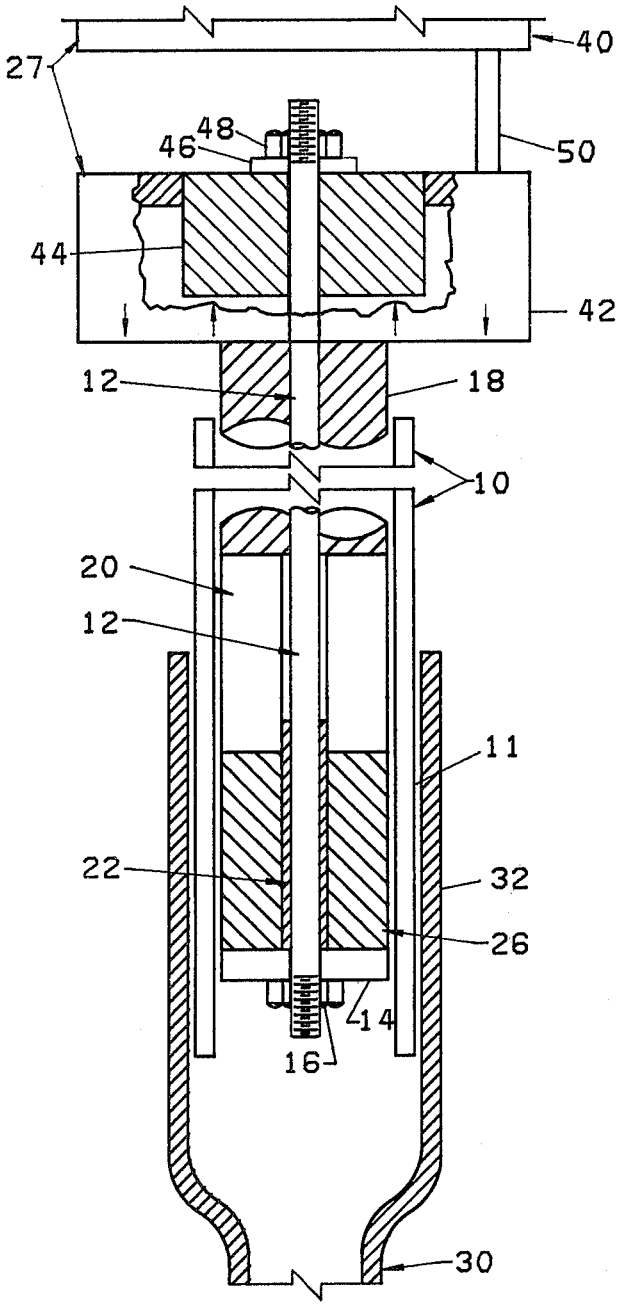
FIG. 1 is a longitudinal cross-section of the apparatus before tube expansion showing the push-pull means located outside of the tube, and an end segment of the first tube mated with a female opening of an end sleeve segment of the second tube.

Referring in detail now to the drawings wherein like or similar parts of the invention are identified by like reference numerals, FIG. 1 defines a first tube, generally illustrated as 10, including an end segment 11. A shaft generally illustrated as 12 extends axially inside tube 10. Tube 10 may consist of an engineering alloy such as A572 steel. An inner cap 14 is bound to shaft 12 by nut 16 for longitudinal axial movement in combination with shaft 12 with respect to tube 10. The minimum diameter of shaft 12 is limited by the yield strength of the metal alloy used in its construction; however it is normally one-third the diameter of tube 10. An outer cap 18 is mounted on shaft 12 so as to be able to slide on and along shaft 12 in a longitudinal axial direction with respect to tube 10.

Figure 2:
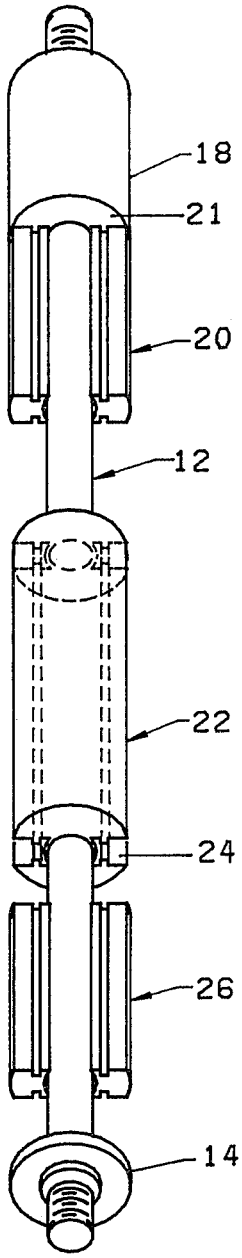
FIG. 2 is an expanded view of the bushing means, elastomeric bar, inner cap, and outer cap with attached prong means positioned on the shaft.
Figure 3:
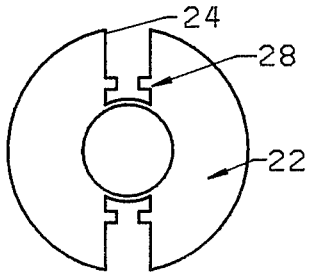
FIG. 3 is an end view of the bushing means showing the longitudinal slot and retaining means therein.

As depicted in FIG. 2, a prong means, generally illustrated as 20, is attached to inner face 21 of outer cap 18. A bushing means, generally illustrated as 22, is slidably mounted on and along shaft 12 between inner cap 14 and outer cap 18 for longitudinal axial movement on and along shaft 12 with respect to tube 10. Bushing means 22 includes at least one longitudinal slot 24 which longitudinally traverses bushing means 22 and is sized to mate with prong means 20. Elastomeric means 26 is sized to lodge within bushing slot 24. Elastomeric means 26 may consist of any elastomer although an elastomer having a high resilience such as hard urethane rubber is preferred. Shaft 12, outer cap 18, inner cap 14, prong means 20 and bushing means 22 may comprise any material having a hardness and strength greater than that of elastomeric means 26. Retaining means 28 as depicted in FIG. 3 comprises at least one groove longitudinally traversing the inner wall of bushing means slot 24 and which serves to hold elastomeric means 26 in place. Elastomeric means 26 is sized to mate with retaining means 28 when lodged within bushing slot 24. As depicted in FIG. 1, the invention also comprises a second tube generally illustrated as 30 with an end sleeve segment 32. Tube 30 may consist of any common alloy such as A572. The length of bushing means 22 and elastomeric means 26 depend upon the amount of contact required between tube 10 and tube 30 to prevent axial pullout; however the length of bushing means 22 is typically one to two times the diameter of end segment 11. The non-expanded remainder of tube 30 may have the same or different diameter than tube 10. End sleeve segment 32 defines a female opening to slidably mate with end segment 11 of tube 10 such that the inner surface of end sleeve segment 32 overlaps the outer surface of end segment 11. End segment 11 generally has the same diameter as the remainder of tube 10; however the term "end segment" is used to illustrate that portion of tube 10 which is inserted into end sleeve segment 32.

Figure 4:
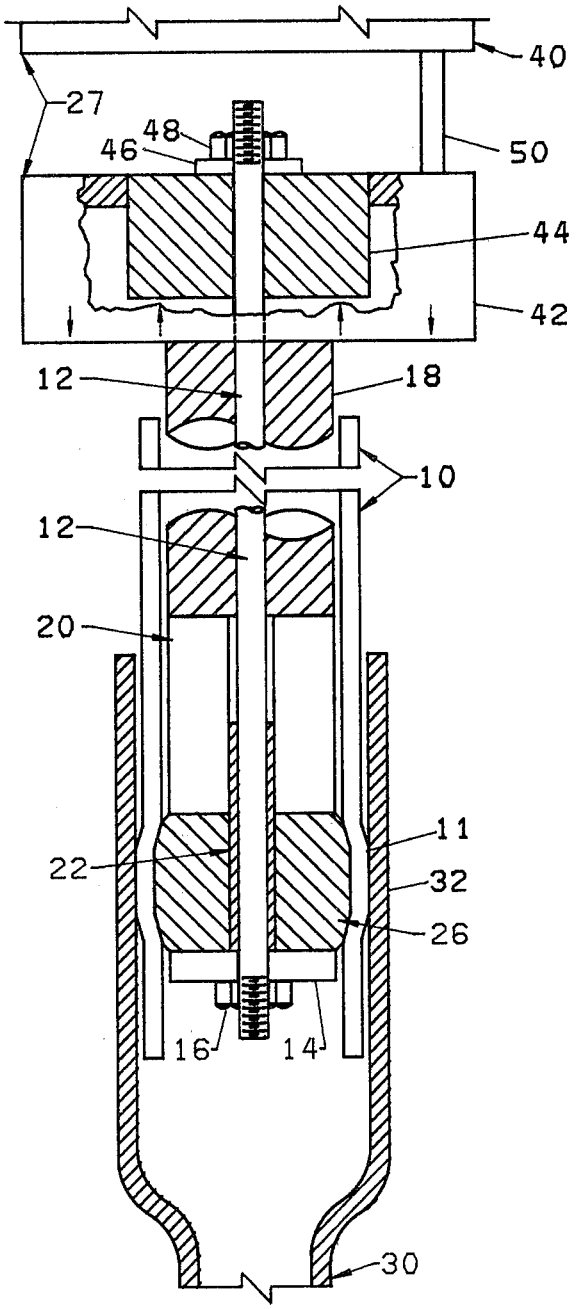
FIG. 4 is a longitudinal cross-section of the apparatus showing the end segment of the first tube joined by selective expansion with the end sleeve segment of the second tube.
Figure 5:
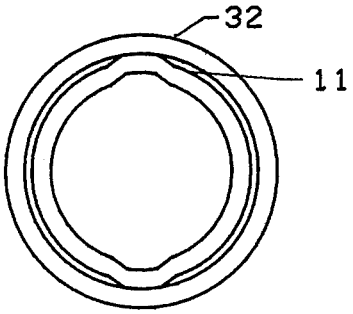
FIG. 5 is a cross sectional end view at the area of tube expansion showing the annular spaces between the tubes resulting from selective expansion of one tube into another tube.

Bushing means 22 including elastomeric means 26 is located within end segment 11. For ease of alignment, prong means 20 is registered within bushing slot 24 prior to locating bushing means 22 and outer cap 18 within end segment 11. The invention also comprises a means, generally illustrated as 27, for pulling shaft 12 in one axial direction, an upward direction when viewing FIG. 4, while simultaneously pushing outer cap 18 in the opposite axial direction, a downward direction when viewing FIG. 4, such that when inner cap 14 contacts bushing means 22, prong means 20 contacts elastomeric means 26. The push-pull means 27 is exemplified by a hydraulic pump generally illustrated as 40, and a combination of an outer cylinder 42 and an inner cylinder 44. Inner cylinder 44 is located inside outer cylinder 42 such that the longitudinal axes of both cylinders are concentrically aligned. Shaft 12 extends through outer cylinder 42 and inner cylinder 44 along their respective longitudinal axes. Shaft 12 is secured to inner cylinder 44 by end cap 46 and nut 48. Fluid is delivered under pressure from pump 40 through fluid conduit 50 into outer cylinder 42. The pressurized fluid acting against the inner surface of outer cylinder 42 transmits a push force through outer cap 18 to elastomeric means 22 while at the same time the fluid acting against the outer surface of inner cylinder 44 transmits a pull force through cap 46 to shaft 10. The continuing respective axial forces from pulling and pushing, in combination with prong means 20 in contact with elastomeric means 26 within bushing means 22, compress and subsequently radially expand elastomeric means 26 at selective points against the inner surface of end segment 11. The selective radial expansion of elastomeric means 26 against end segment 11 cause the selective radial expansion of end segment 11 against the end sleeve segment 32 to form a selective interference fit between the outer surface of end segment 11 and the inner surface of end sleeve segment 32. The resulting effect as depicted in FIG. 5 is to lock tube 10 to tube 30 to prevent axial pullout yet provide passageways for fluids or other materials to pass through the annular spaces between the area where end segment 11 is expanded into end sleeve segment 32. In order to provide end sleeve segment 32 with external hoop strength to counteract the expansion forces of the elastomeric means 26, tube 30, including end sleeve segment 32, may have a larger wall thickness to provide the necessary radial restraining force. Upon reversal of the push-pull means, elastomeric means 26 relaxes, allowing shaft 12 in combination with inner cap 14, outer cap 18, and elastomeric means 26 to be withdrawn from tube 10.

When the push-pull means 27 is located exterior to tube 10, as depicted in FIG. 1, outer cap 18 is sized to extend from a location in proximity to an open end of tube 10 at the point of contact with elastomeric means 26 in proximity to the area of proposed tube expansion inside tube 10. The distance between the open end of tube 10 and the area of proposed tube expansion however, generally may not be more than ten feet because Euler buckling principles limit the length of outer cap 18 to approximately ten feet.

Figure 6:
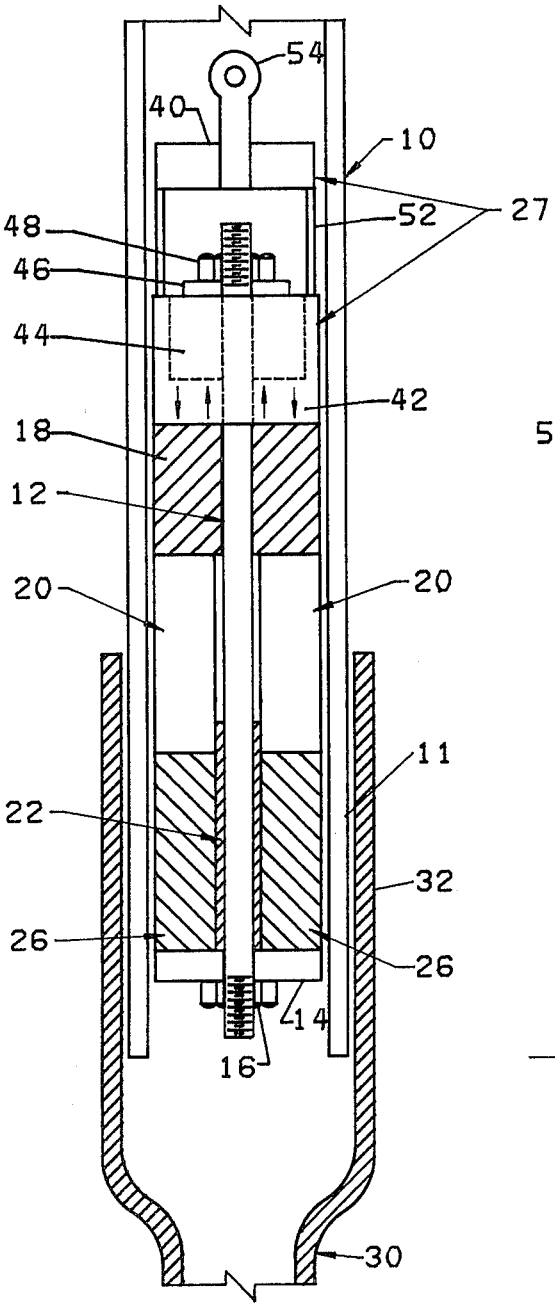
FIG. 6 is a longitudinal cross-section of the apparatus showing the push-pull means located inside the first tube in proximity to the area of proposed expansion.

When tube 10 has a diametr of approximately three inches or more, the push-pull means 27 may be located inside tube 10 as depicted in FIG. 6. Hydraulic pump 40 is rigidly attached to outer cylinder 42 by brackets 52. Brackets 52 may contain hollow conduits for the passage of fluid under pressure from pump 40 to outer cylinder 42, or a separate fluid conduit (not shown in drawings) may be used. A pad eye 54 mounted to pump 40 is attached to a cable (not shown in drawings) in order to lower the apparatus inside tube 10 when tube 10 is in the vertical position. The ability to place push-pull means 27 inside tube 10 allows tube expansion to be conducted at distances greater than ten thousand feet from an open end of tube 10 without the Euler buckling limitations of an elongated outer cap 18. The only limitations to placing the push-pull 27 means inside tube 10 is the length of the cable and the ability of the cable to support the weight of the apparatus. Therefore, there would be no limitation on the distance from the open end of the tube to the proposed zone of expansion, thereby allowing for tube expansion deep within a tube as for example when expanding to join tubular piling into a tubular anchor located in the ocean floor. Other prior art is deficient in this area, being limited to tube expansion at or in proximity with the open end of the tube.

Figure 7:
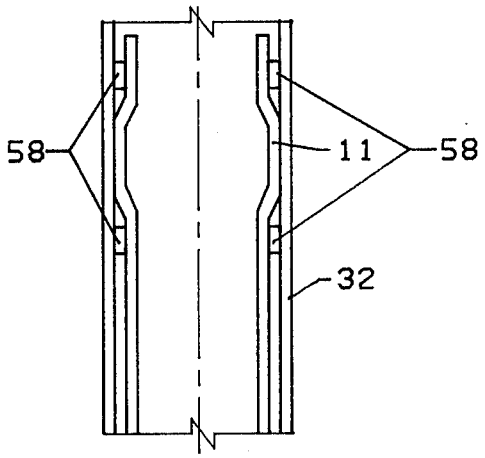
FIG. 7 is a longitudinal cross section of the apparatus showing expansion of the first tube end segment against the nodes attached to the inner surface of the end sleeve segment of the second tube.
Figure 8:
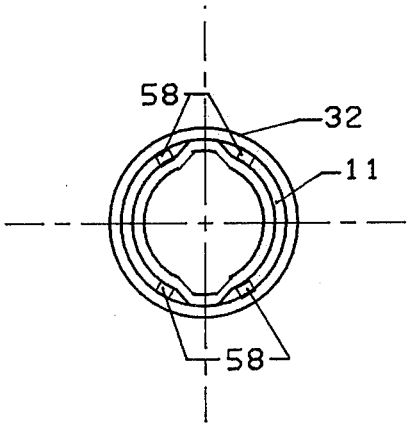
FIG. 8 is a cross sectional end view at the area of tube expansion of the first tube end segment against the nodes attached to the inner surface of the end sleeve segment of the second tube.

In order to increase the resistance of tube 10 and tube 30 to axial pullout, end sleeve segment 32 as depicted in FIG. 7 includes a plurality of nodes 58 attached to the inner wall of end sleeve segment 32. Nodes 58 are located along the inner surface of end sleeve segment 32 in a longitudinal direction and about the circumference of the inner surface such that the wall of end segment 11 is selectively radially expanded between and against nodes 58 in both a longitudinal and circumferential direction. Expansion of end segment 11 between between and against nodes 58 creates a mechanical lock resulting in stronger resistance to axial pull out of tube 10 from tube 30.

In order that the compression forces of inner cap 14 and bushing means 22 are fully transmitted to elastomeric means 26, the outer edge of inner cap 14, the outer edge of outer cap 18, and the outer surface of bushing means 22 are sized to generally conform to the size and shape of the inner surface of end segment 11; in addition, prong means 20 is sized to generally conform to the size and shape of bushing means slot 24. Application of compression forces over the entire end surface of elastomeric means 26 assures maximum compression and therefore maximum selective radial expansion of elastomeric means 26.

While the present invention has been described herein with reference to particular embodiments thereof, a latitude of modification, various changes and substitutions are introduced in the foregoing disclosure, and in some instances some features of the invention would be employed without a corresponding use of others without departing from the scope of the invention as set forth.

We claim:

1. An apparatus for joining at least one pair of tubes by selectively radially expanding a first tube into a second tube in proximity to their respective ends to form a selective interference fit between the tubes comprising:

(a) the first tube including a shaft extending axially therein;

(b) an inner cap bound to the shaft for longitudinal axial movement in combination with the shaft with respect to the first tube;

(c) an outer cap slidably mounted on and along the shaft for longitudinal axial movement on and along the shaft with respect to the first tube, said outer cap including at least one prong means bound thereto;

(d) a bushing means slidably mounted on and along the shaft between the outer cap and the inner cap for longitudinal axial movement on and along the shaft with respect to the first tube, said bushing means including a structure defining at least one longitudinal slot which longitudinally traverses said bushing means, said longitudinal slot registering said prong means therein;

(e) an elastomeric means slidably lodged within the longitudinal slot of said bushing means;

(f) the second tube with an end sleeve segment having a greater diameter than the first tube, said end sleeve segment defining a female opening to slidably mate with an end segment of said first tube, which includes the elastomeric means therein, such that the inner surface of the end sleeve segment of the second tube overlaps the outer surface of the end segment of the first tube; and (g) a means for pulling the shaft in one axial direction while simultaneously pushing the outer cap in the opposite axial direction such that when the inner cap contacts the bushing means and the prong means contacts the elastomeric means the continuing respective axial forces from pulling and pushing, in combination with the prong means of the outer cap in contact with the elastomeric means within the longitudinal slot, compress and thereby radially expand the elastomeric means at predetermined selective points against the end segment wall of the first tube causing said wall to expand against the inner surface of the end sleeve segment of the second tube to form a selective interference fit therebetween.

2. The apparatus for joining at least one pair of tubes by selective interference fit as recited in claim 1 wherein the means for pulling the shaft in one axial direction while simultaneously pushing the outer cap in the opposite axial direction is located inside the first tube.

3. The apparatus for joining at least one pair of tubes by selective interference fit as recited in claim 1 wherein the means for pulling the shaft in one axial direction while simultaneously pushing the outer cap in the opposite axial direction is located outside the first tube.

4. The apparatus for joining at least one pair of tubes by selective interference fit as recited in claim 3 wherein when said inner cap is in contact with said bushing means and the prong means of said outer cap is in contact with said elastomeric means, said outer cap is sized to extend longitudinally on the shaft from a location in proximity to an open end of the first tube to the bushing means.

5. The apparatus for joining at least one pair of tubes by selective interference fit as recited in claim 1 wherein the end sleeve segment of the second tube includes a plurality of nodes attached to the inner surface of said end sleeve segment, said nodes positioned on the inner surface such that the end segment wall of the first tube is selectively radially expanded between and against said nodes to form a selective interference fit between the end segment wall of the first tube and said nodes.

6. The apparatus for joining at least one pair of tubes by selective interference fit as recited in claim 5 wherein the outer edge of the inner cap, the outer edge of the outer cap and the outer surface of the bushing means are sized to generally conform to the shape and size of the end segment inner surface of the first tube, and the prong means is sized to generally conform to the circumferential size and shape of the longitudinal slot of the bushing means.

7. The apparatus for joining at least one pair of tubes by selective interference fit as recited in claim 6 wherein the longitudinal slot of said bushing means includes at least one retaining means longitudinally traversing the inner wall of said longitudinal slot such that said elastomeric means mates with said retaining means to hold said elastomeric means within said longitudinal slot.

8. A process for joining at least one pair of tubes by selectively radially expanding a first tube into a second tube in proximity to their respective ends to form a selective interference fit between the tubes comprising the following steps:

(a) placing a shaft axially inside a first tube, said shaft having an inner cap bound thereto for longitudinal axial movement in combination with the shaft with respect to the first tube;

(b) mounting a bushing means, including at least one longitudinal slot which longitudinally traverses said bushing means, slidably on and along the shaft for longitudinal axial movement on and along the shaft with respect to the first tube, said bushing means having an elastomeric means slidably lodged within said longitudinal slot;

(c) mounting an outer cap, including at least one prong means bound thereto, slidably on and along the shaft for longitudinal axial movement on and along the shaft with respect to the first tube such that said prong means is slidably lodged within the longitudinal slot of said bushing means, said outer cap positioned on the shaft such that the elastomeric means is between said prong means and said inner cap;

(d) sizing an end sleeve segment of the second tube such that said end sleeve segment has a larger diameter than the first tube;

(e) registering an end segment of the first tube, which includes the elastomeric means therein, within the end sleeve segment of the second tube such that the inner surface of the end sleeve segment of the second tube overlaps the end segment outer surface of the first tube; and (f) pulling the shaft in one axial direction while simultaneously pushing the outer cap in the opposite axial direction such that when the inner cap contacts the bushing means and the prong means of said outer cap contacts the elastomeric means the continuing respective axial forces from pulling and pushing, in combination with the prong means of the outer cap in contact with the elastomeric means within the longitudinal slot, compress and thereby radially expand the elastomeric means at predetermined selective locations against the end segment wall of the first tube causing selective radial expansion of the wall of the first tube end segment against the inner surface of the end sleeve segment of the second tube to form a selective interference fit therebetween.

9. The process for joining at least one pair of tubes by selective interference fit as recited in claim 8 additionally comprising locating the means for pulling the shaft in one axial direction while simultaneously pushing the outer cap in the opposite axial direction inside the first tube.

10. The process for joining at least one pair of tubes by selective interference fit as recited in claim 8 additionally comprising locating the means for pulling the shaft in one axial direction while simultaneously pushing the outer cap in the opposite axial direction outside the first tube.

11. The process for joining at least one pair of tubes by selective interference fit as recited in claim 10 additionally comprising sizing the outer cap to extend longitudinally on the shaft from a location in proximity to an open end of the first tube to the bushing means, when said inner cap is in contact with said bushing means and the prong means of said outer cap is in contact with said elastomeric means.

12. The process for joining at least one pair of tubes by selective interference fit as recited in claim 8 additionally comprising attaching a plurality of nodes to the inner surface of said end sleeve segment, said nodes positioned on the inner surface such that the end segment wall of the first tube is selectively radially expanded between and against said nodes to form a selective interference fit between the end segment wall of the first tube and said nodes.

13. The process for joining at least one pair of tubes by selective interference fit as recited in claim 12 additionally comprising sizing the outer edge of the inner cap, the outer edge of the outer cap and the outer surface of the bushing means to generally conform to the shape and size of the end segment inner surface of the first tube, and sizing the prong means to generally conform to the circumferential size and shape of the longitudinal slot of the bushing means.

14. The process for joining at least one pair of tubes by selective interference fit as recited in claim 13 additionally comprising traversing longitudinally the inner wall of the longitudinal slot of said bushing means with at least one retaining means such that said elastomeric means mates with said retaining means to hold said elastomeric means within said longitudinal slot.

* * * * *